US010317052B2

(12) United States Patent
King, Jr. et al.

(10) Patent No.: US 10,317,052 B2
(45) Date of Patent: Jun. 11, 2019

(54) BATTERY POWERED LED SET UP STAND

(71) Applicant: The Patent Store, LLC, Jefferson City, MO (US)

(72) Inventors: L. Herbert King, Jr., Chesterfield, MO (US); James Keeven, O'Fallon, MO (US); William Hiner, O'Fallon, MO (US)

(73) Assignee: The Patent Store, LLC, Jefferson City, MO (US)

( * ) Notice: Subject to any disclaimer, the term of this patent is extended or adjusted under 35 U.S.C. 154(b) by 419 days.

(21) Appl. No.: 14/998,750

(22) Filed: Feb. 10, 2016

(65) Prior Publication Data

US 2017/0227197 A1 Aug. 10, 2017

(51) Int. Cl.

| | |
|---|---|
| ***F21V 21/06*** | (2006.01) |
| ***F21V 23/06*** | (2006.01) |
| ***F21V 21/08*** | (2006.01) |
| ***F21V 21/116*** | (2006.01) |
| *F21W 131/109* | (2006.01) |
| *F21Y 115/10* | (2016.01) |

(52) U.S. Cl.

CPC ..... *F21V 21/06* (2013.01); *F21V 21/0824* (2013.01); *F21V 21/116* (2013.01); *F21V 23/06* (2013.01); *F21W 2131/109* (2013.01); *F21Y 2115/10* (2016.08)

(58) Field of Classification Search

CPC ..... F21L 4/00; F21L 4/02; F21L 4/04; F21L 4/06; F21L 4/08; F21S 9/022–9/037; F21S 2/005; F21S 9/02; F21S 8/081; F21S 8/083; F21V 23/06; F21V 21/0824; F21V 21/06

See application file for complete search history.

(56) References Cited

U.S. PATENT DOCUMENTS 3,104,064 A * 9/1963 Bellek ..... F21S 8/081 362/267
3,601,595 A * 8/1971 Kivela ..... F21L 4/04 362/190
4,536,705 A 8/1985 Hayes
(Continued)

FOREIGN PATENT DOCUMENTS

CA 2858564 2/2016

OTHER PUBLICATIONS

Non-Final Office Action from the U.S. Patent and Trademark Office for U.S. Appl. No. 15/330,451 dated Jun. 27, 2018 (13 pages).

*Primary Examiner* — Anh T Mai
*Assistant Examiner* — Steven Y Horikoshi
(74) *Attorney, Agent, or Firm* — Michael Best & Friedrich LLP

(57) ABSTRACT

A portable LED self-powered set up stand for temporary field placement, powering and repositioning an LED light without having to wire or rewire the LED light if a field placement of a LED light is changed with the set up stand having a first extension for temporary on-the-go connection to one of a set of support bases and a second extension for temporary on-the-go connection to a second extension supporting an LED light in a viewable condition with the LED set up stand including an internal replaceable dc power source for temporarily powering an LED light during a field installation, creation and light evaluation of an LED light display.

19 Claims, 2 Drawing Sheets

(56) References Cited

U.S. PATENT DOCUMENTS

| | | | | |
|---|---|---|---|---|
| 4,999,060 | A * | 3/1991 | Szekely | F21S 8/081 136/251 |
| 6,082,877 | A * | 7/2000 | Hughes | F21S 6/005 362/152 |
| 7,021,787 | B1 * | 4/2006 | Kuelbs | A45B 3/04 362/183 |
| 9,668,053 | B1 * | 5/2017 | Rivera | H04R 3/12 |
| 2002/0101571 | A1 * | 8/2002 | Panasewicz | F21V 21/0824 353/119 |
| 2004/0201992 | A1 * | 10/2004 | Dalton | F21S 9/02 362/276 |
| 2008/0084711 | A1 | 4/2008 | Chen | |
| 2008/0151545 | A1 * | 6/2008 | Kratz | F21V 21/0824 362/249.01 |
| 2008/0211412 | A1 | 9/2008 | Chen | |
| 2014/0070708 | A1 | 3/2014 | Zhu | |
| 2015/0167943 | A1 * | 6/2015 | Rugendyke | F21L 4/04 362/294 |
| 2016/0026073 | A1 * | 1/2016 | Zhang | G03B 21/142 353/101 |
| 2016/0341407 | A1 | 11/2016 | Manfred | |

* cited by examiner

BATTERY POWERED LED SET UP STAND

CROSS REFERENCE TO RELATED APPLICATIONS

None

STATEMENT REGARDING FEDERALLY SPONSORED RESEARCH OR DEVELOPMENT

None

REFERENCE TO A MICROFICHE APPENDIX

None

BACKGROUND OF THE INVENTION

One of the more popular light displays uses LED lights, which typically may be arranged in a temporary holiday yard display or in a more permanent light display. One of the difficulties with designing and setting up a light display is that after the LED lights are arranged in the desired pattern the field installer needs to connect each of the LED lights to a power source in order to obtain the full visual effect of the light display, which allows one to observe and decide if any of the LED lights should be relocated. Unfortunately, if there are a number of LED lights that need to be rearranged it becomes time consuming for the installer to move and rewire each of the LED lights until the proper LED arrangement is obtained. The invention described herein allows an installer to quickly and on-the-go set up, arrange or rearrange a LED light within an LED yard display without having to wire or rewire the LED lights each time a LED light in the light display is moved, or replaced.

SUMMARY OF THE INVENTION

A portable, battery powered LED set up stand for field installer use in creation of a low voltage LED yard display through on-the-go field placement of LED lights within an LED yard display. The LED set up stand can power an LED light as the installer locates or relocates the LED light in the LED yard display without the installer having to wire or rewire the LED light each time an LED light is relocated. The LED set up stand having a first extension for connection to one of a set of interchangeable support bases to enable mounting or attachment of the LED set up stand to different types of surfaces. The LED set up stand including a second extension for temporarily supporting a variety of LED light products thereon with the LED set up stand carrying an internal low voltage replaceable dc power source for powering an LED light product secured thereto during an on-the-go creation of an LED yard display through a process of on-the-go locating and relocating of LED lights within the LED yard display.

DESCRIPTION OF THE PREFERRED EMBODIMENT

Figure 1:
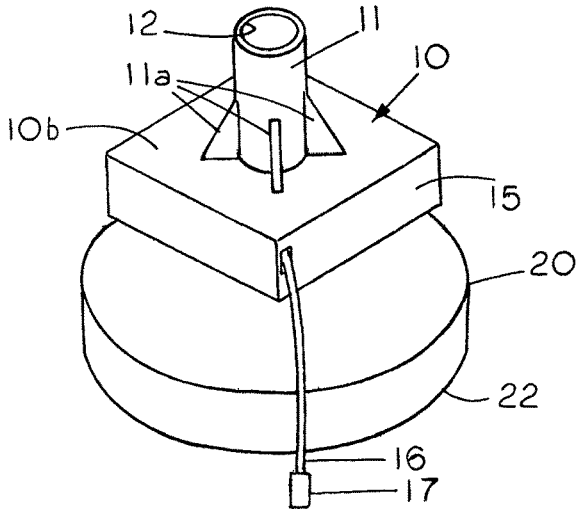
FIG. 1 is a perspective view of the portable battery powered LED set up stand attached to a flat bottom support base.
Figure 4:
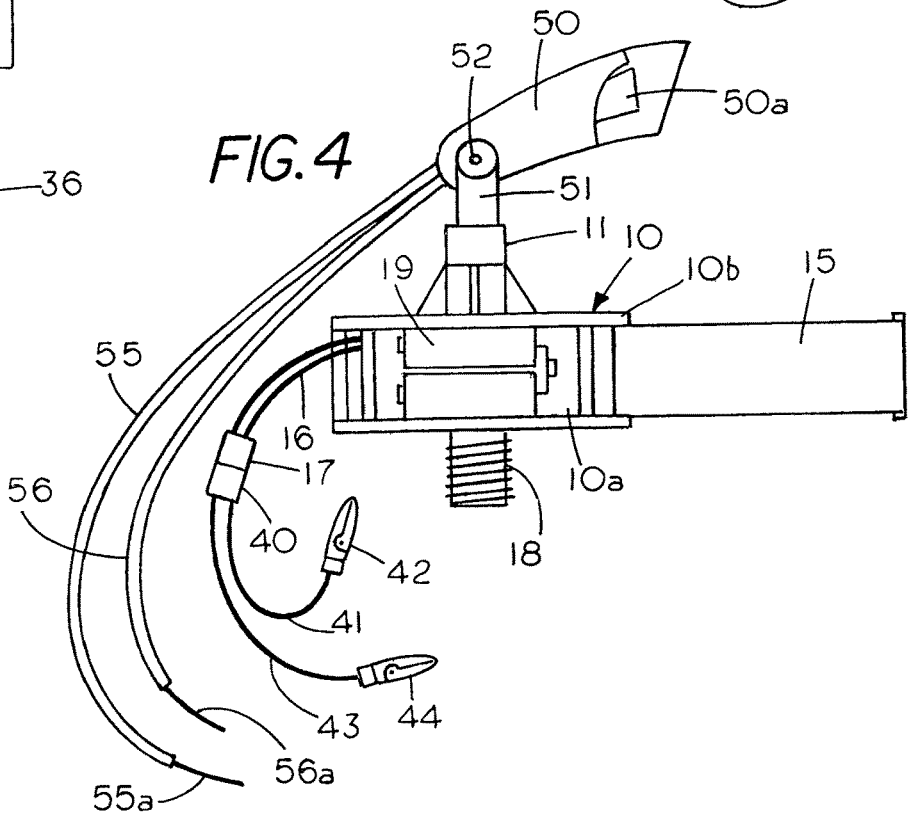
FIG. 4 is a side view of the portable battery powered LED set up stand revealing a battery compartment and a LED light mounted to a top side of the LED set up stand.

FIG. 1 is a perspective view of a portable battery powered LED set up stand 10, with the bottom of the set up stand 10 secured to the top of a flat bottom cylindrical support base 20 and FIG. 4 shows the portable battery powered LED set up stand 10 with the top of the set up stand 11 connected to an LED light base 51 in just one of the ways the versatility of the LED stand can be used to support and display LED lights.

In the example of FIG. 1 portable battery powered LED set up stand 10 comprises a rectangular shaped housing 10*b* with a female thread 12 in extension 11 for temporary threaded securement to the under side of an LED light fixture. Extension 11 includes a set of radial fins 11*a* for supporting the extension 11 in a vertical or upright orientation on a top side of housing 10*b*. LED set up stand 10 and extension 11 preferably comprise a lightweight polymer plastic with extension 11 having an internal thread 12 for temporary threaded engagement with a variety of LED light fixtures that may be used in arranging a field display of LED lights. LED set up stand housing 10*b* includes a sliding panel 15 that slides open to permit access to a battery compartment 10*a* located within the housing 10*b* (FIG. 4). An electrical wire 16 with a two socket female connector 17 extends from the battery compartment within the LED set up stand 10 to supply dc power from batteries therein to a LED light or the like that is secured to the set up stand 10 to provide a water resistant stand around the set of batteries therein. In the example shown the LED set up stand 10 is supported in an upright condition on a flat surface through a flat underside 22 of base 20. Preferably, base 20 is a high-density material that provides sufficient weight so that, the base 20, which extends beyond the edges of the LED set up stand, provides a stability that prevents accidental tipping the LED set up stand 10 during use.

Figure 2:
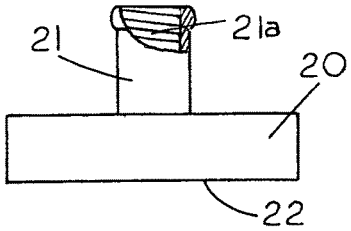
FIG. 2 is an isolated side view of the flat bottom support base of FIG. 1.

FIG. 2 is a partially sectional side view of the flat bottom circular support base 20 of FIG. 1 revealing a hollow extension 21 extending from the top of the support base 20 with the extension 21 having a set of internal threads 21*a* for temporarily engaging a threaded male extension 18 (FIG. 4) on the bottom of LED set up stand 10. Support base 20 is well suited for supporting the LED set up stand on a solid surface or floor since the weighted mass of support base 20 provides stability without need for permanent or temporary attachment of the support base to a surface or floor. Preferably the base weighs more than the housing LED set up stand 10 and the LED lights mounted thereon to enhance the field stability of the LED set up stand.

The field installer often must set up LED light displays in a variety of different configurations and on a variety of different support surfaces, which can hinder set up of an LED light display. A feature of LED set up stand 10 is that it provides the versatility to accommodate different support surfaces with the same LED set up stand through use of a set of interchangeable bases.

Figure 3:
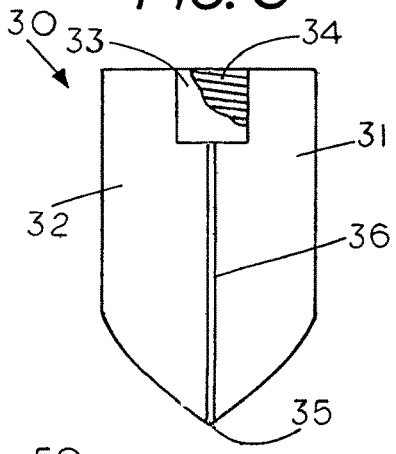
FIG. 3 is a front view of an additional support base comprising a flat blade stake for soil engagement.
Figure 3A:
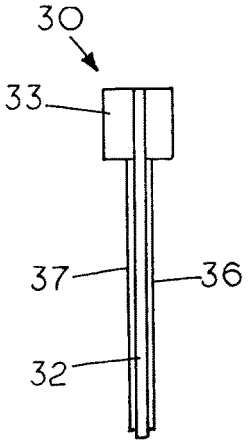
FIG. 3A is a side view of the flat blade stake of FIG. 3.

FIG. 3 is a front view of an example of a second type of support base 30 and FIG. 3A is a side view of support base 30 that can be temporarily secured to the LED set up stand 10 to provide stable support on soil surfaces. Support base 30 comprises a pointed stake that includes a first flat side blade 31 and a second flat side blade 32 joined by a central reinforcing rib 36 located between internal edges of blades 31 and 32. The end of blades 31 and 32 converge to an apex 35 for ease in soil penetration. That is, the support base 30 forms a pointed stake that can be hand forced into soil by the installer to temporarily support the LED set up stand 10 during the evaluation of an LED light display. After evaluation of the light display is completed the stake 40 and the LED set up stand 10 can be removed from the soil for reuse in another location and the LED light can be permanently mounted and hardwired for part of a permanent LED display. Thus, a feature of the invention is that the field installer can use the LED set up stand with a variety of different support bases independent of the LED light carried in the LED set up stand.

FIG. 3 shows a top portion of stake 30 includes a hub 33 having a set of internal threads 34 for temporary threaded engagement of an extension 18 (FIG. 4) on the bottom of the LED set up stand 10 that enables the LED set up stand 10 to be supported either by the stake 30, which can be forced into the soil, or the base 20 of FIG. 2, which can be placed on a flat surface. That is, stake 30 and base 20 are interchangeable with each other so that a user can select one or the other to mount to the underside of set up stand 10. Thus, a field installer can support the LED set up stand 10 in different field conditions by merely engaging the lower threads 18 on the set up stand 10 with an appropriate base. A feature of the invention is size and shape of the LED set up stand and the support bases are sufficiently large and hand graspable so the filed installer can through hand grasping and without the aid of tools attach or remove an LED light or a support base from the LED set up stand. Consequently, the selection of the appropriate support base from a set of support bases can be determined on-the-go and set up without hand tools during an LED setup phase by the field installer.

FIG. 4 is a side view of LED set up stand 10 revealing a sliding door 15, which slides on guides or rails within the housing (not shown) to provides access to a battery compartment 10*a* with a set of batteries 19 therein. Typically, the low voltage source in the LED set up stand comprise eight 1.5 volt dry cell batteries, which are connected in series to deliver 12 volts although higher or lower low voltage sources may be used. A sliding battery door 15, which is shown in the open condition in FIG. 4, permits access to the batteries 19 in the battery compartment 10*a* for quick replacement of spent batteries. A feature of the invention described herein is that the batteries need not be replaced for many hours since the present invention take advantage of the current consumption of an LED light being low. A further feature is that the use of a low voltage power source avoids safety problems that can occur with 120 volt power sources, which may be reduced to a lower voltage, since the LED light set up stand 10 can eliminate the presence of harmful 120 volts during the setting up of the LED display.

In the example of FIG. 4, which is partially in section, an LED light 50*a* mounts in a shroud 50 with the shroud 50 pivotally mounted to support 51, which has a lower end threaded into the female threads 34 in top extension 11 on LED set up stand 10. The pivotal mounting permits one to adjust the angular orientation of the LED light on-the-go.

Extending from LED light 50*a* is a first low voltage electrical lead 55 having a bared end 55*a* and a second low voltage electrical lead 56 having a bared end 56*a*, which are used to power the LED light 50*a* located in shroud 50.

In order to power the LED light 50*a* through the LED set up stand 10 there is provided an electrical cord 16 and a female connector 17, which connects to the batteries 19 in the LED set up stand 10. In this example a male connector 40 connects to female connector 17 with a male connector 40 having a first electrical lead 41 with a first alligator clip 42 attached thereto for forming a first temporary electrical connection to bared wire 56*a* and a second electrical lead 43 having a second alligator clip 44 attached thereto for forming a second temporary electrical connection to bared wire 55*a* to provide low voltage dc power to illuminate the LED light 50. Thus, a feature of the LED self-powered set up stand is that LED set up stand can be independently positioned of other LED lights with the LED light on the LED set up stand and powered independently of other LED lights by connecting each of the alligator clips 44 and 42 to the electrical leads 55*a* and 56*a* of the LED light 50*a*. Conversely, if one wants to determine how the light arrangement would appear without the LED light 50*a* one can merely disconnect one of the alligator clips 42 or 44 to depower the LED light 50*a*. While quick clip connectors such as alligator clips are preferred other types of connections may be used without departing from the spirit and scope of the invention.

Figure 5:
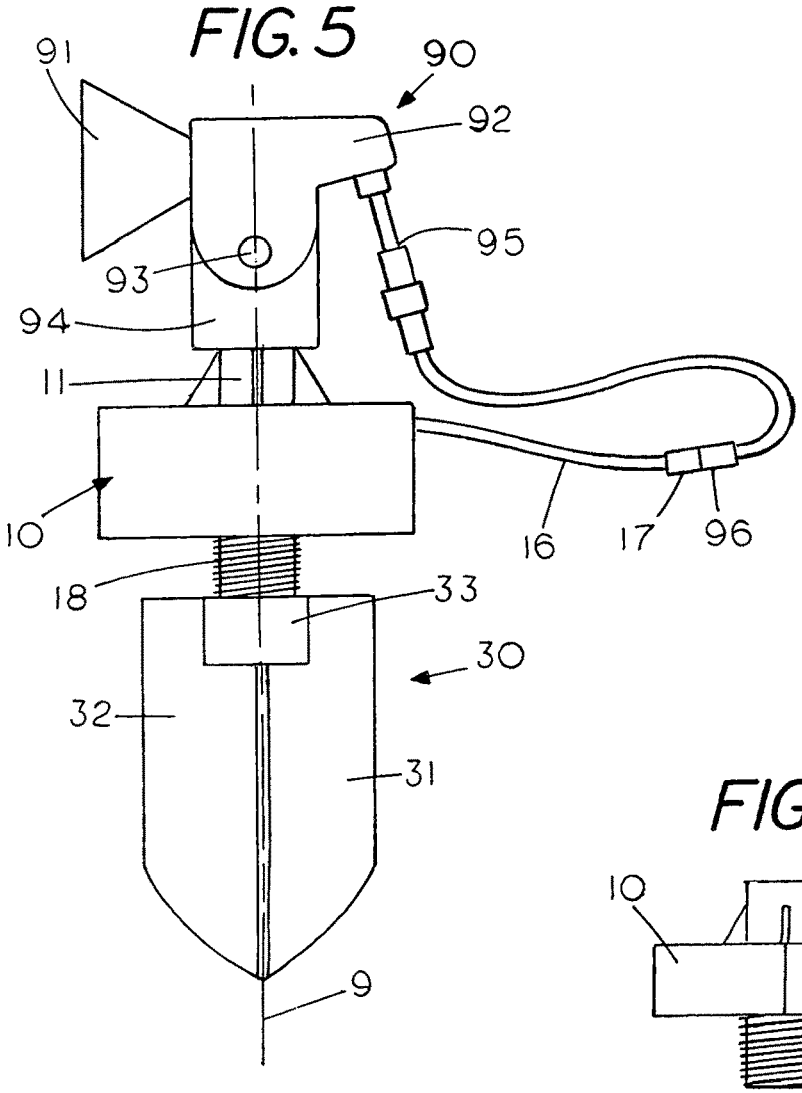
FIG. 5 is a side view of a laser light mounted on the portable battery powered LED set up stand with a flat blade stake for temporary soil support of the laser light.

FIG. 5 is a side view of the LED set up stand 10 in combination with a support stand 30 attached to the underside of stand 10 and a light 90 attached to the top of set up stand 10. In this example a laser light 91 mount on the LED set up stand 10 with a support base comprising a flat blade stake 30 that is threadingly engaged with a lower threaded extension 18. Stake 30 allows one quickly and easily provide the LED set up stand with soil support. The example of FIG. 5 illustrates the first extension 11 and the second extension 30 are located along a common axis 9, which enhances the stability of the LED set up stand during the placement and evaluation of an LED light display.

FIG. 5 shows the LED set up stand 10 has the top cylindrical extension 11 supporting a different LED housing 94 having a pivotal pin 93 for pivotally supporting housing 92 thereon. In this example a laser light 91 is attached to housing 92 through an electrical connection such as a socket connection (not shown). An electrical lead 95 from light 91 includes a male electrical connector 96 that connects to female connector 17 for temporary powering of laser light 91 as the visual appearance of a laser light arrangement is evaluated. In this example to power or depower light 91 one merely connects or disconnects female connector 17 and male connector 96. FIG. 5 illustrates the versatility of the LED set up stand 10 since it can accommodate different LED lights as well as different types of electrical connections, a feature appreciated by the person setting up the field display.

Figure 6:
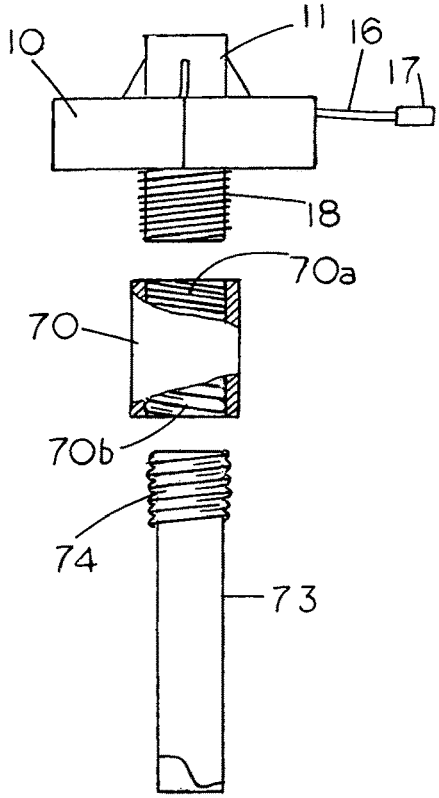
FIG. 6 is an exploded view of the portable battery powered LED set up stand with a coupling and pole for vertically position an LED light during arrangement of a light display.

While the support base 20 and 30 are used for mounting the LED set up stand on a support surface the set up stand 10 includes a further support base that permits vertical positioning of an LED light. FIG. 6 shown an exploded view of the LED set up stand 10 with another type of support base with the support base including a female coupling 70 and a pole 73 having a threaded end. In this embodiment the coupling 70 has a first set of threads on one end that matches the threads on extension 18 on the LED set up stand 10 and a second set of threads 70*b* on the opposite end that matches the threads typically found on a broom handle or the like, which is usually 5 or less threads per inch. A feature of the support shown in FIG. 6 is a pole or convention broom handle 73 can be used to vertically support or position the LED set up stand 10. The pole 73 enables a person to elevate or lower the LED so the LED light can be viewed in different positions as part of the process of setting up an LED landscape design. Thus, the invention enables both vertical and horizontal temporary positioning of LED lights to allow the installer to evaluate the most desirable location of the individual LED lights in the light system. A further feature is that if desired, the lower end of the pole can be sharpened or fitted with a blade to allow the pole to hold the LED stand and the LED light at an elevated condition.

Thus, a feature of the invention is an installer friendly method of LED set up and temporary viewing of an LED light display without the necessity to hard wire the LED lights. Typically, an operator may form a set of stand alone components by attaching an LED light to a self-powered LED set up stand having a support base. The operator than has the ability to form a LED light arrangement using numerous LED set up stands with each LED set up stand independently powered. In the next step the operator places the first powered set up stand in a first location and further self powered set up stands in other locations to complete the LED light layout without having to hardwire any of the LED lights. In the next step the operator illuminates each of the LED lights on the self powered set up stands using the dc power source on the self powered set up stand. Once powered the operator can view the LED light display to determine if any of LED lights should be removed or rearranged, which the operator can do without having to connector or disconnect the LED lights since each of the LED set up stands contain their own power source. During the set up process some of the self-powered set up stand can be mounted on a flat bottom base and others can be mounted on a stake while others may be mounted on a pole.

A further feature of the invention is that one can replace an LED light on a self-powered set up stand with a different LED light, for example a different color LED. In addition the method may include the step of powering at least one of the LED lights through a temporary electrical connection from the self powered LED set up stand and electrical leads from the LED light.

A further feature is that one can replace the dry cell batteries in the first powered LED set up stand with a fresh set of dry cell batteries, which preferably may be AA dry cell batteries, which are commercially available and inexpensive.

We claim:

1. A portable battery powered LED set up stand for temporary arranging, viewing and on-the-go evaluation of LED yard display comprising:

a housing having a compartment therein;

a DC voltage source located in said compartment;

a first extension comprising a socket extending from a first side of said housing with said socket having an internal thread for temporary securement of an LED light fixture thereto;

a second extension extending from the opposite side of said housing with said second extension having a set of external threads for attachment to a base;

a first electrical lead having a first end connected to a positive side of the DC voltage source and a second end having an alligator clip for forming a first temporary electrical connection;

a second electrical lead having a first end connected to the negative side of the DC voltage with a second end having a second alligator clip for forming a second temporary electrical connection; and a support base connected to said second extension for maintaining a fixed orientation of the LED set up stand during the evaluation of the LED yard display.

2. The portable LED set up stand of claim 1 wherein the support base is removably attached to the extension of the LED set up stand with the support base holding the LED set up stand in an upright condition.

3. The portable LED set up stand of claim 1 wherein the first extension and the second extension are located along a common axis.

4. The portable LED set up stand of claim 1 wherein the support base comprise a blade having a first end for soil insertion and a second end for threaded engagement with the second extension to temporarily maintain an LED light in the set up stand in a viewable condition.

5. The portable LED set up stand of claim 1 including a female coupling having a first end with a female thread greater than 5 thread per inch for engaging a thread on the second extension and a second end with a second thread for engaging a broom handle wherein the pitch on thread for engaging the broom handle is 5 or less threads per inch.

6. A portable LED set up stand comprising:

a housing;

a DC voltage source carried in said housing;

a first extension from a top side of said housing for temporary securement of an LED light thereto;

a second extension on said housing;

a first electrical lead for forming a first temporary electrical connection extending outside of the housing from a negative pole of the DC voltage source in said housing;

a second electrical lead for forming a second temporary electrical connection extending outside of the housing from a positive pole of the DC voltage source in said housing, wherein the first electrical lead and the second electrical lead include a first alligator clip and a second alligator clip, respectively, for temporary powering of the LED light connected to the DC voltage source; and a support base connected to said housing to maintain a fixed orientation of the LED light during an evaluation of the LED yard display containing the LED light.

7. The LED set up stand of claim 6 wherein the DC voltage source comprises eight 1.5 volt batteries.

8. The LED set up stand of claim 6 wherein the first extension includes an LED socket and the second support base extension on the opposite side of the housing are located in axial alignment with each other.

9. The LED set up stand of claim 6 including a coupler for attachment to the second extension on the LED set up stand.

10. The LED set up stand of claim 9 wherein the coupler has a female thread of a first pitch on one end for engaging the LED set up stand and a female thread of a different pitch on the other end for engaging a support base.

11. The LED set up stand of claim 6 wherein the DC voltage source includes AA batteries.

12. The LED set up stand of claim 6 wherein the extension on the top of the housing and the bottom of the housing are located axially opposite of each other.

13. A method of setting up a temporary viewing an LED light display of a set of LED lights, the method comprising the steps of:

attaching a first LED light of the set of LED lights to a first self powered LED set up stand having a support base, attaching a first LED light including connecting the first LED light to a DC power source within the first self powered LED set up stand via a first electrical lead extending outside of a housing of the first self powered set up stand, wherein the first electrical lead includes a first alligator clip;

attaching a second LED light of the set of LED lights to a second self powered LED set up stand having a support base, attaching a second LED light including connecting the second LED light to a DC power source within the second self powered set up stand via a second electrical lead extending outside of a housing the second self powered set up stand, wherein the second electrical lead includes a second alligator clip;

placing the first powered LED set up stand in a first location and the further self-powered LED set up stand in a second location;

illuminating the LED light on the first self powered LED set up stand using the DC power source within the self powered LED set up stand and the LED on the further self powered LED set up stand using a DC power source within the further self powered set up stand; and viewing the LED light display with the first LED light and the second LED light to determine if either of the first LED light or the second LED light should be removed or rearranged.

14. The method of claim 13 including the step of mounting the self powered LED set up stand on a flat bottom base.

15. The method of claim 14 including the step of mounting the further self powered LED set up stand on a stake.

16. The method of claim 14 including the step of replacing an LED light on either the first self powered LED set up stand or the further LED setup stand with a different LED light.

17. The method of claim 14 including the step of powering at least one of the LED lights through a temporary electrical connection from the respective self powered set up stand and an electrical lead from the LED light.

18. The method of claim 14 including the step of replacing a set of batteries in the first powered set up stand with a fresh set of batteries.

19. The method of claim 14 the step of attaching a pole to a housing of the first self powered LED set up stand and elevating the self powered set up stand and the LED light thereon to provide a different visual arrangement of LED lights.

* * * * *